US012209762B2

(12) United States Patent
Atchison

(10) Patent No.: US 12,209,762 B2
(45) Date of Patent: Jan. 28, 2025

(54) SYSTEMS AND METHODS FOR OPERATING AN HVAC SYSTEM IN A CALIBRATION MODE

(71) Applicant: Air Distribution Technologies IP, LLC, Milwaukee, WI (US)

(72) Inventor: Shaun B. Atchison, Wichita, KS (US)

(73) Assignee: Tyco Fire & Security GmbH, Neuhausen am Rheinfall (CH)

( * ) Notice: Subject to any disclaimer, the term of this patent is extended or adjusted under 35 U.S.C. 154(b) by 433 days.

(21) Appl. No.: 17/499,668

(22) Filed: Oct. 12, 2021

(65) Prior Publication Data

US 2023/0114521 A1 Apr. 13, 2023

(51) Int. Cl.

| | |
|---|---|
| ***F24F 11/65*** | (2018.01) |
| ***F24F 11/52*** | (2018.01) |
| ***F24F 11/74*** | (2018.01) |
| ***F24F 11/88*** | (2018.01) |
| *F24F 110/30* | (2018.01) |

(52) U.S. Cl.

CPC ..... *F24F 11/65* (2018.01); *F24F 11/52* (2018.01); *F24F 11/74* (2018.01); *F24F 11/88* (2018.01); *F24F 2110/30* (2018.01)

(58) Field of Classification Search

CPC .. F24F 11/65; F24F 11/52; F24F 11/74; F24F 11/88; F24F 2110/30; F24F 11/32; F24F 2110/10; F24F 11/30; F24F 11/49; F24F 11/46; G01K 15/005; G01K 15/00

See application file for complete search history.

(56) References Cited

U.S. PATENT DOCUMENTS 4,884,214 A * 11/1989 Parker ..... F24F 11/523 700/278
5,179,524 A * 1/1993 Parker ..... F24F 11/77 165/238
5,364,024 A * 11/1994 Lin ..... F24F 11/00 236/44 C (Continued)

FOREIGN PATENT DOCUMENTS

CA 2957726 A1 3/2016
CA 3043996 A1 2/2018

(Continued)

OTHER PUBLICATIONS

CoolingLogic, "CoolingLogic: Up early, saving billions." URL: http://coolinglogic.com/documents/MarketingFlyer_FINAL_HiRes8.5x11.pdf, retrieved from internet Oct. 27, 2022 (1 page).

(Continued)

*Primary Examiner* — Alicia M. Choi
(74) *Attorney, Agent, or Firm* — Fletcher Yoder, P.C.

(57) ABSTRACT

A heating, ventilation, and/or air conditioning (HVAC) system includes a set of electrical switches and a controller configured to determine a calibration value of an operating parameter of the HVAC system based on a plurality of configurations of the set of electrical switches during operation of the HVAC system in a calibration mode, receive a measured value of the operating parameter from a sensor of the HVAC system during the operation of the HVAC system in the calibration mode, and determine a parameter value adjustment for the measured value based on a comparison of the measured value and the calibration value.

17 Claims, 7 Drawing Sheets

(56) References Cited

U.S. PATENT DOCUMENTS

| | | | | |
|---|---|---|---|---|
| 9,447,985 | B2 | 9/2016 | Johnson | |
| 10,871,756 | B2 | 12/2020 | Johnson et al. | |
| 10,908,578 | B2 | 2/2021 | Johnson et al. | |
| 10,921,768 | B2 | 2/2021 | Johnson et al. | |
| 10,983,014 | B2 | 4/2021 | Rümler | |
| 11,156,978 | B2 | 10/2021 | Johnson et al. | |
| 2005/0043907 | A1* | 2/2005 | Eckel | G01K 1/08 374/E1.008 |
| 2007/0286319 | A1* | 12/2007 | Cleitus | H03L 7/02 375/354 |
| 2013/0067941 | A1* | 3/2013 | Lee | F24F 11/46 62/126 |
| 2017/0016642 | A1* | 1/2017 | Spalink | F24F 11/46 |
| 2017/0130981 | A1* | 5/2017 | Willette | F24F 11/30 |
| 2018/0045447 | A1* | 2/2018 | Berg | F25B 13/00 |
| 2019/0025809 | A1* | 1/2019 | Bhattacharya | G05B 15/02 |
| 2019/0101303 | A1* | 4/2019 | Kaliyaperumal | F24F 11/32 |
| 2020/0149763 | A1* | 5/2020 | Mukherjee | F24F 11/30 |
| 2020/0217524 | A1* | 7/2020 | Atchison | F24F 11/54 |

FOREIGN PATENT DOCUMENTS

| | | | |
|---|---|---|---|
| CN | 216144437 | U * | 3/2022 |
| EP | 3 186 687 | A4 | 7/2017 |
| EP | 3 497 377 | A1 | 6/2019 |
| KR | 101413441 | B1 | 7/2014 |

OTHER PUBLICATIONS

Incomplete File of Communication with Various Companies, etc. in 2016-2021, URL: http://coolinglogic.com/documents/22072101_Letters_and_Signature_Receipts.pdf, published, as one document, on: Jul. 21, 2022 (211 pages).

Johnson Heating and Cooling L.L.C., "Divine Grace Building Automation (Images)," URL: http://cooljohnson.com/Building-Automation-Systems-Michigan/Oakland-County-Michigan/Building-Automation-Images.html, retrieved from internet Oct. 27, 2022 (8 pages).

Johnson Heating and Cooling L.L.C., "Divine Grace Building Automation," URL: http://cooljohnson.com/Building-Automation-Systems-Michigan/Oakland-County-Michigan/Building-Automation-Divine-Grace.html, retrieved from internet Oct. 27, 2022 (3 pages).

Johnson Heating and Cooling L.L.C., "Excel Rehabilitation Building Automation," URL: http://cooljohnson.com/Building-Automation-Systems-Michigan/Waterford-Michigan/Building-Automation-System--Excel.html, retrieved from internet Oct. 27, 2022 (2 pages).

Johnson Heating and Cooling L.L.C., "Intertek Testing Services Building Automation," URL: http://cooljohnson.com/Building-Automation-Systems-Michigan/Plymouth-Michigan/Building-Automation-System-Plymouth-Michigan.html, retrieved from internet Oct. 27, 2022 (8 pages).

Johnson Heating and Cooling L.L.C., "JLA Medical Building Building Automation," URL: http://cooljohnson.com/Building-Automation-Systems-Michigan/Waterford-Michigan/Building-Automation-System--JLA.html, retrieved from internet Oct. 27, 2022 (3 pages).

Johnson Heating and Cooling L.L.C., "Mosaic Christian Building Automation (Images)," URL: http://cooljohnson.com/Building-Automation-Systems-Michigan/Detroit/Building-Automation-Images.html, retrieved from internet Oct. 27, 2022 (12 pages).

Johnson Heating and Cooling L.L.C., "Mosaic Christian Building Automation," URL: http://cooljohnson.com/Building-Automation-Systems-Michigan/Detroit/Mosaic-Christian.html, retrieved from internet Oct. 27, 2022 (5 pages).

Johnson Heating and Cooling L.L.C., "Shepherd's Gate Lutheran Church Building Automation," URL: http://cooljohnson.com/Building-Automation-Systems-Michigan/Shelby-Township-Michigan/Building-Automation-Systems-SG.html, retrieved from internet Oct. 27, 2022 (3 pages).

Johnson Heating and Cooling L.L.C., "St. Clair County Residence Building Automation," URL: http://cooljohnson.com/Building-Automation-Systems-Michigan/St-Clair-Michigan/Building-Automation-System-St-Clair-Michigan.html, retrieved from internet Oct. 27, 2022 (4 pages).

Johnson Heating and Cooling L.L.C., "St. Joseph Mercy Oakland U. C. Building Automation," URL: http://cooljohnson.com/Building-Automation-Systems-Michigan/Waterford-Michigan/Building-Automation-Systems-SJMO.html, retrieved from internet Oct. 27, 2022 (2 pages).

Johnson Heating and Cooling L.L.C., "Waterford Internal Medicine Building Automation," URL: http://cooljohnson.com/Building-Automation-Systems-Michigan/Waterford-Michigan/Building-Automation-Systems-WIM.html, retrieved from internet Oct. 27, 2022 (3 pages).

Johnson Heating and Cooling, LLC, "Building Automation Clawson Michigan 2.0," URL: http://cooljohnson.com/Building-Automation-Systems-Michigan/Clawson-Michigan/Building-Automation-Clawson-Manor-2.html, retrieved from the internet Oct. 27, 2022 (6 pages).

Johnson Heating and Cooling, LLC, "Building Automation Images Clawson Michigan 2.0," URL: http://cooljohnson.com/Building-Automation-Systems-Michigan/Clawson-Michigan/Building-Automation-Clawson-Manor-2-Images.html, retrieved from the internet Oct. 27, 2022 (14 pages).

Johnson Heating and Cooling, LLC, "Building Automation System Clawson Michigan Clawson Manor," URL: http://cooljohnson.com/Building-Automation-Systems-Michigan/Clawson-Michigan/Building-Automation-System-Clawson-Manor.html; retrieved from the internet Oct. 27, 2022 (3 pages).

Johnson Heating and Cooling, LLC, "Building Automation System in Michigan Images," URL: http://cooljohnson.com/Building-Automation-Systems-Michigan/Macomb-County-Michigan/Building-Automation-Images.html; retrieved from the internet Oct. 27, 2022 (13 pages).

Johnson Heating and Cooling, LLC, "Building Automation System in Michigan," URL: http://cooljohnson.com/Building-Automation-Systems-Michigan/Macomb-County-Michigan/Building-Automation-Confidential-Customer.html; retrieved from the internet, Oct. 27, 2022 (4 pages).

Johnson Solid State LLC, "Building Automation Equipment," URL: http://cooljohnson.com/Video/Building_Automation/Confidential_Customer_BLD_2/Building_Automation_Equipment.mp4, retrieved from internet Oct. 27, 2022 (35 pages).

Johnson Solid State LLC, "Building Automation GUI," URL: http://cooljohnson.com/Video/Building_Automation/Confidential_Customer_BLD_2/Building_Automation_GUI.mp4, retrieved from internet Oct. 27, 2022 (24 pages).

Johnson Solid State LLC, "Cooling Logic Overview," URL: http://coolinglogic.com/documents/CoolingLogic_Overview_High_Quality.mp4, retrieved from internet Oct. 27, 2022 (16 pages).

Johnson Solid State LLC, "So what is CoolingLogic™?" URL: http://coolinglogic.com/Coolinglogic-How-it-Works.html, retrieved from the internet Oct. 27, 2022 (3 pages).

Johnson, David, "A Method to Increase HVAC System Efficiency And Decrease Energy Consumption," White Paper: Johnson Solid State, LLC, URL: http://coolinglogic.com/documents/16102106_White_Paper_High_Resolution_Protected.pdf, Sep. 24, 2016 (51 pages).

Johnson, David, "CoolingLogic™: Mosaic Christian Church A Case Study," Report: Johnson Solid State, LLC, URL: http://coolinglogic.com/documents/19020301_Mosaic_Christian_Coolinglogic_Case_Study.pdf, Feb. 2, 2019 (140 pages).

Johnson, David, "Excel Rehabilitation Building Automation: Building Automation System User Manual ," URL: http://cooljohnson.com/Building-Automation-Systems-Michigan/Waterford-Michigan/Building-Automation-System-Excel-Manual.html, 2012 (10 pages).

Johnson, David, "Temperature Control System and Methods for Operating Same," Pre-Publication printout of U.S. Appl. No. 15/231,943, filed Aug. 9, 2016, URL: http://coolinglogic.com/documents/16080901_CIP_As_Filed.pdf (99 pages).

(56) References Cited

OTHER PUBLICATIONS

Johnson, David., "CoolingLogic™: Changing the Way You Cool," Report: Johnson Solid State, LLC, URL: http://coolinglogic.com/documents/18111303_Changing_the_way_you_Cool.pdf, Nov. 7, 2018 (12 pages).
Degree Controls, Inc., "Rooster Airflow Alarm Monitor, User Instructions & Product Specifications", 2013, 26 pages, Milford, New Hampshire.
Red Lion Controls, "Model IFMA—Din-Rail Frequency To Analog Converter", Bulletin No. IFMA-F, Jul. 2009, 8 pages, York, Pennsylvania.

* cited by examiner

SYSTEMS AND METHODS FOR OPERATING AN HVAC SYSTEM IN A CALIBRATION MODE

BACKGROUND

This section is intended to introduce the reader to various aspects of art that may be related to various aspects of the present disclosure and are described below. This discussion is believed to be helpful in providing the reader with background information to facilitate a better understanding of the various aspects of the present disclosure. Accordingly, it should be noted that these statements are to be read in this light, and not as admissions of prior art.

Heating, ventilation, and/or air conditioning (HVAC) systems are utilized in residential, commercial, and industrial environments to control environmental properties, such as temperature and humidity, for occupants of the respective environments. An HVAC system may control the environmental properties through control of a supply air flow delivered to the environment. For example, the HVAC system may place the supply air flow in a heat exchange relationship with a refrigerant of a vapor compression circuit to condition the supply air flow. The HVAC system may include a variety of sensors configured to monitor different operating parameters, such as temperature and humidity, that may be referenced during operation of the HVAC system to condition the supply air flow. Unfortunately, the accuracy of the data measured by the sensors may change over time. As a result, operation of the HVAC system based on data from the sensors may be impacted.

SUMMARY

A summary of certain embodiments disclosed herein is set forth below. It should be noted that these aspects are presented merely to provide the reader with a brief summary of these certain embodiments and that these aspects are not intended to limit the scope of this disclosure. Indeed, this disclosure may encompass a variety of aspects that may not be set forth below.

In one embodiment, a heating, ventilation, and/or air conditioning (HVAC) system includes a set of electrical switches and a controller configured to determine a calibration value of an operating parameter of the HVAC system based on a plurality of configurations of the set of electrical switches during operation of the HVAC system in a calibration mode, receive a measured value of the operating parameter from a sensor of the HVAC system during the operation of the HVAC system in the calibration mode, and determine a parameter value adjustment for the measured value based on a comparison of the measured value and the calibration value.

In one embodiment, a non-transitory, computer-readable medium including instructions that, when executed by processing circuitry, are configured to cause the processing circuitry to determine a calibration value of an operating parameter of a heating, ventilation, and/or air conditioning (HVAC) system based on a plurality of configurations of a set of electrical switches of the HVAC system during operation of the HVAC system in a calibration mode, determine a parameter value adjustment for a measured value received via a sensor of the HVAC system based on a comparison of the measured value and the calibration value in the calibration mode, and communicate data based on an additional configuration of the set of electrical switches during operation of the HVAC system in a normal mode.

In one embodiment, a controller includes a set of electrical switches, an additional electrical switch, processing circuitry, and a memory that includes instructions. When executed by the processing circuitry, the instructions are configured to cause the processing circuitry to initiate operation in a calibration mode in response to a detection of an initial configuration of the set of electrical switches and a detection of an initial actuation of the additional electrical switch, determine a plurality of air flow rate calibration values based on a plurality of configurations of the set of electrical switches during the operation in the calibration mode, receive a first plurality of measured air flow rate values from a sensor during the operation in the calibration mode, each measured air flow rate value of the first plurality of measured air flow rate values corresponding to an air flow rate calibration value of the plurality of air flow rate calibration values, determine an adjustment to a second plurality of measured air flow rate values received from the sensor during operation o in a normal mode based on a comparison of the plurality of air flow rate calibration values and the first plurality of measured air flow rate values, and operate in the normal mode based on the adjustment to the second plurality of measured air flow rate values

DRAWINGS

Various aspects of this disclosure may be better understood upon reading the following detailed description and upon reference to the drawings in which.

DETAILED DESCRIPTION

Figure 1:
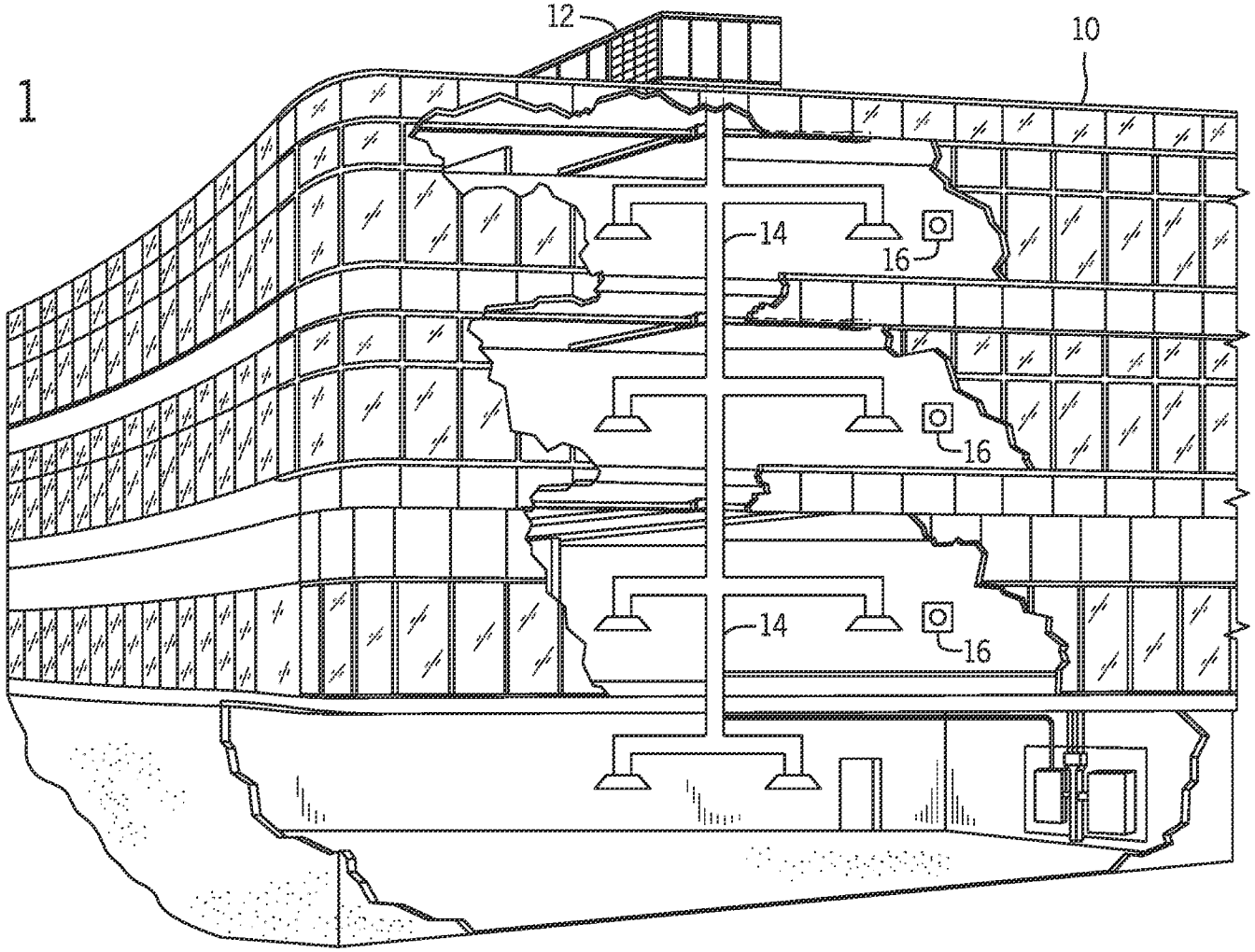
FIG. 1 is a perspective view of an embodiment of a heating, ventilation, and/or air conditioning (HVAC) system for environmental management that may employ one or more HVAC units, in accordance with an aspect of the present disclosure.

One or more specific embodiments will be described below. In an effort to provide a concise description of these embodiments, not all features of an actual implementation are described in the specification. It should be noted that in the development of any such actual implementation, as in any engineering or design project, numerous implementation-specific decisions must be made to achieve the developers' specific goals, such as compliance with system-related and business-related constraints, which may vary from one implementation to another. Moreover, it should be noted that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be noted that references to "one embodiment" or "an embodiment" of the present disclosure are not intended to be interpreted as excluding the existence of additional embodiments that also incorporate the recited features.

The present disclosure is directed to a heating, ventilation, and/or air conditioning (HVAC) system. The HVAC system may operate to condition (e.g., cool, heat, dehumidify) a supply air flow and to deliver the supply air flow to a space serviced by the HVAC system in order to condition the space. In some embodiments, the HVAC system may include sensors configured to monitor different operating parameters, such as a flow rate of air (e.g., the supply air flow, a return air flow) through the HVAC system, a humidity of the space and/or an air flow, a temperature of the space and/or the air flow, an amount of carbon dioxide or other particle within the space and/or the air flow, a parameter of a refrigerant circulated in the HVAC system, and so forth. A controller of the HVAC system may operate a component of the HVAC system based on sensor data received from the sensors and indicative of determined operating parameter values.

Unfortunately, accuracy of the sensors may change, such as due to wear of the sensors (e.g., caused by usage) and/or certain factors specific to the HVAC system in which the sensors are incorporated (e.g., environmental or weather elements, wiring configurations, HVAC component dimensions or design specifications, sensor positioning with respect to other HVAC components). Thus, the measured operating parameter value determined by one of the sensors may not accurately reflect an actual operating parameter value to be detected by the sensor. As an example, a measured flow rate of air determined by a sensor may be greater or less than the actual flow rate of air through the HVAC system. The accuracy of the sensors may affect operation of the HVAC system. For instance, the HVAC system may not condition the space as desired.

Thus, it is presently recognized that adjusting the operation of the HVAC system to reconcile changes in accuracy of the sensors may improve operation of the HVAC system to condition the space. Accordingly, embodiments of the present disclosure are directed to a system and method for operating the HVAC system in a calibration mode to reconcile accuracies in sensor measurements and thereby enable desired operation of the HVAC system based on data from the sensors. For example, the HVAC system may include a controller, a first electrical switch (e.g., a binary switch, a biased switch, an on/off switch), and a set or array of second electrical switches (e.g., a plurality of second electrical switches, a dual-in-line (DIP) switch, a jumper block). In response to actuation of the first electrical switch and positioning of the set of second electrical switches in a particular configuration (e.g., at startup or power up of the HVAC system), the HVAC system may enter and/or operate in the calibration mode.

During the calibration mode, a measured or monitored value of an operating parameter determined by a sensor may be compared (e.g., by a controller of the HVAC system) with a calibration value (e.g., an actual value, a target value, an expected value) of the operating parameter. By way of example, during the calibration mode, the HVAC system may be operated to achieve a particular actual value of the operating parameter, and the set of second electrical switches may be adjusted to input the particular actual value. The controller may then reconcile the particular actual value of the operating parameter input via the set of second electrical switches with the measured value of the operating parameter detected by the sensor, such as via application of a parameter value adjustment (e.g., a gain, an offset) to the particular actual value detected by the sensor. Based on the reconciliation between the actual value input via the set of second electrical switches and the measured value determined by the sensor, subsequent operation of the HVAC system may be based on data from the sensor to condition the supply air flow in a desired manner. For example, during operation of the HVAC system in a normal mode, a parameter value adjustment may be applied to the measured values determined by the sensor to adjust the measured values toward actual, expected, or target values of the operating parameter. Thus, the HVAC system may operate more accurately or desirably based on the sensor data. Although the present disclosure primarily discusses operation of an HVAC system in a calibration mode, in additional or alternative embodiments, a subsystem of the HVAC system (e.g., a fan, a compressor, or a valve) or another system separate from the HVAC system may be operated in the calibration mode using the techniques discussed herein.

Turning now to the drawings, FIG. 1 illustrates an embodiment of a heating, ventilation, and/or air conditioning (HVAC) system for environmental management that may employ one or more HVAC units. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
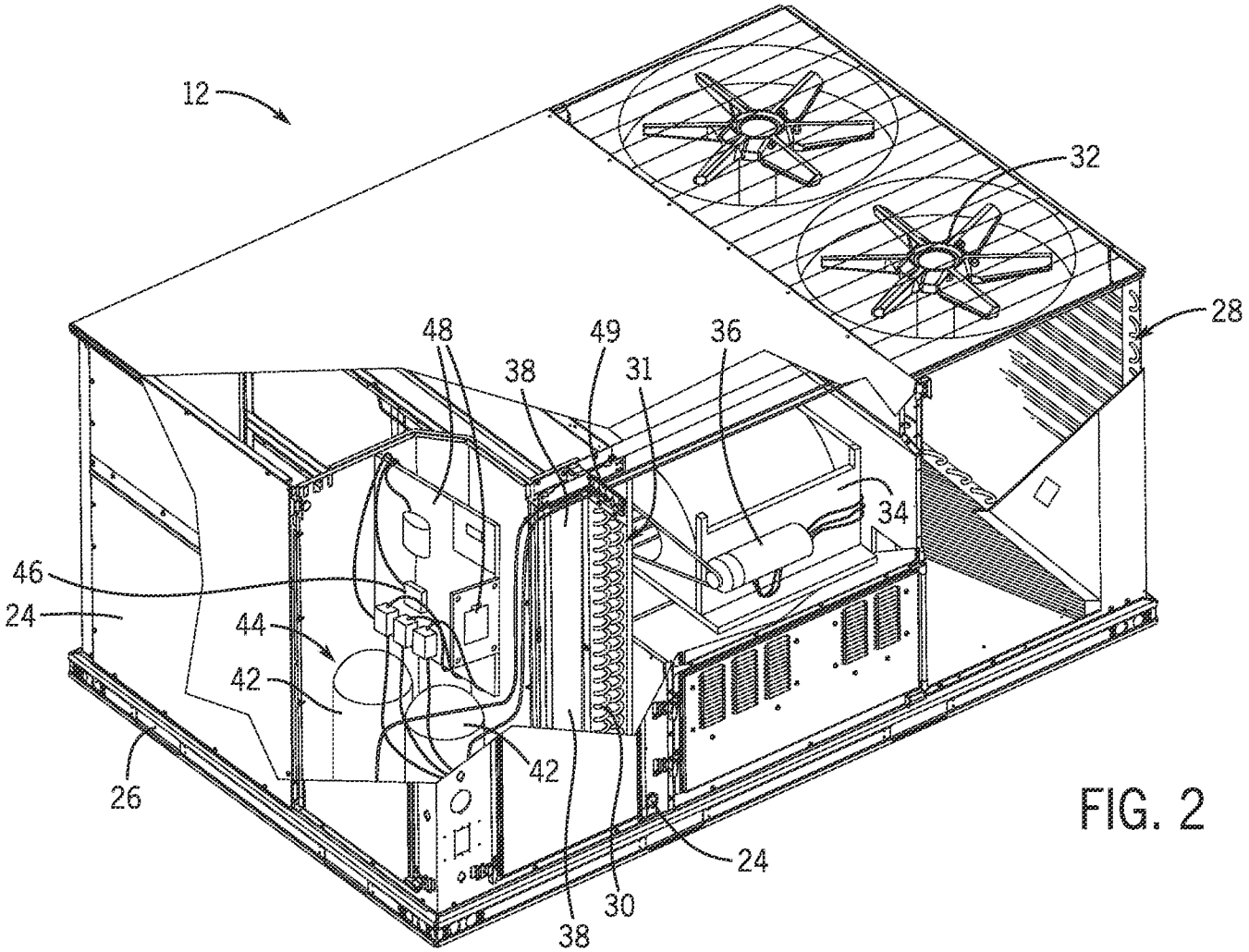
FIG. 2 is a perspective view of an embodiment of a packaged HVAC unit that may be used in the HVAC system of FIG. 1, in accordance with an aspect of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit onto "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant, such as R-410A, through the heat exchangers 28 and 30. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the HVAC unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. Additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
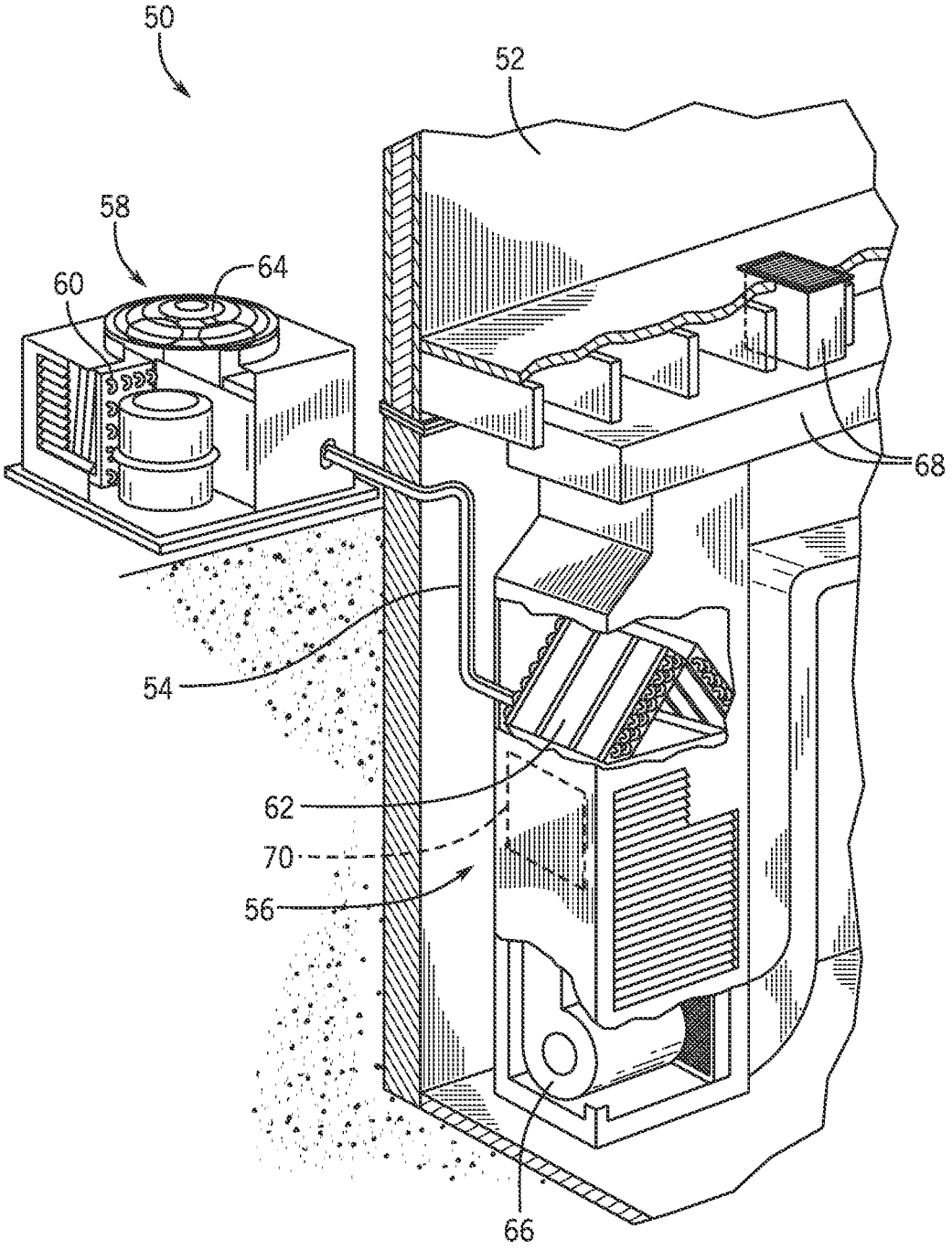
FIG. 3 is a cutaway perspective view of an embodiment of a residential, split HVAC system, in accordance with an aspect of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or the set point plus a small amount, the residential heating and cooling system 50 may become operative to refrigerate additional air for circulation through the residence 52. When the temperature reaches the set point, or the set point minus a small amount, the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over the outdoor heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
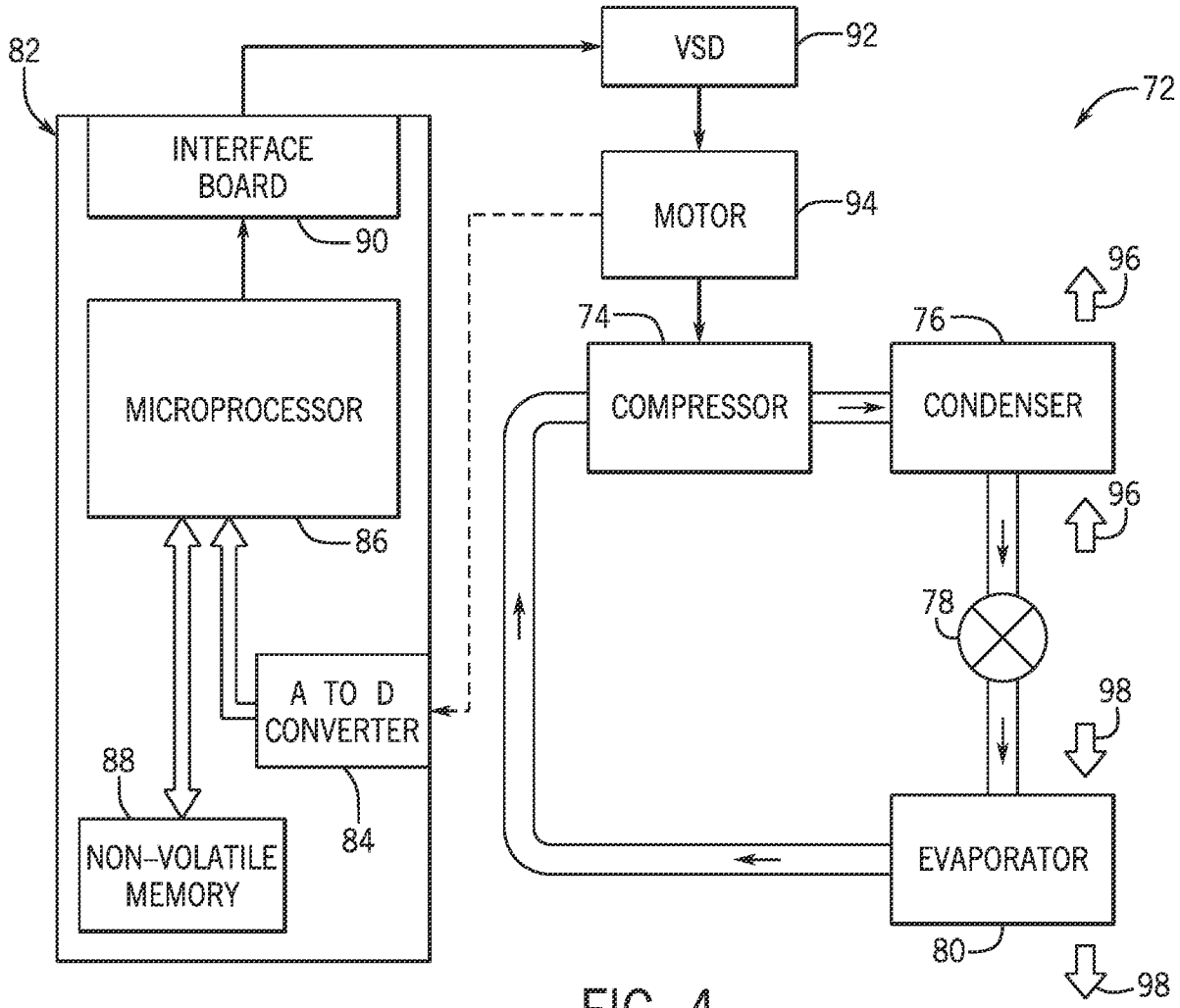
FIG. 4 is a schematic of an embodiment of a vapor compression system that can be used in any of the systems of FIGS. 1-3, in accordance with an aspect of the present disclosure.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 80 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

Any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

The present disclosure is directed to a system and method for operating an HVAC system in a calibration mode to enable desirable operation of the HVAC system during a normal mode. As used herein, operation of the HVAC system in the calibration mode may refer to an operation of the HVAC system to enable reconciliation of a measured operating parameter value determined by a sensor of the HVAC system with an actual (e.g., target, expected) operating parameter value that the sensor should detect (e.g., when the sensor is operating accurately). The actual operating parameter value may be input (e.g., by a user) via a set of electrical switches (e.g., a plurality of electrical switches or contacts) of the HVAC system. Additionally, as used herein, operation of the HVAC system in the normal mode may refer to operation of the HVAC system to condition an air flow (e.g., a supply air flow) and/or a space (e.g., a room of a structure) utilizing measurements detected by the sensor of the HVAC system.

In some embodiments, the calibration mode may be initiated in response to manipulation and/or actuation of one or more first electrical switches (e.g., a binary switch, a biased switch, an on/off switch, a set of electrical switches, a DIP switch, a jumper block). During the calibration mode, the HVAC system may be operated to achieve an actual value (e.g., calibration value) of an operating parameter, which may be measured via calibration equipment, and a configuration of one or more of the first electrical switches may be adjusted to input a calibration value indicative of, or associated with, the actual value of the operating parameter. During the calibration mode, a sensor of the HVAC system may also detect a measurement (e.g., a measured value) of the operating parameter. In some embodiments, a calibration profile may be created based on a comparison of the measured value of the operating parameter detected by the sensor and the actual value of the operating parameter (e.g., determined via the calibration equipment). For example, the calibration profile may include an offset or gain applied to the measured value based on the comparison, such that a discrepancy between the measured value and the actual value is reconciled. Thereafter, the HVAC system may be operated in the normal mode based on the calibration profile. Operation of the HVAC system in the normal mode based on the calibration profile may enable the HVAC system to condition the air flow and/or the space more desirably. For example, initially inaccurate measurements detected by the sensor may be adjusted (e.g., with reference to the calibration profile), and the adjusted measurements may be utilized by the HVAC system to operate in a desired manner.

Figure 5:
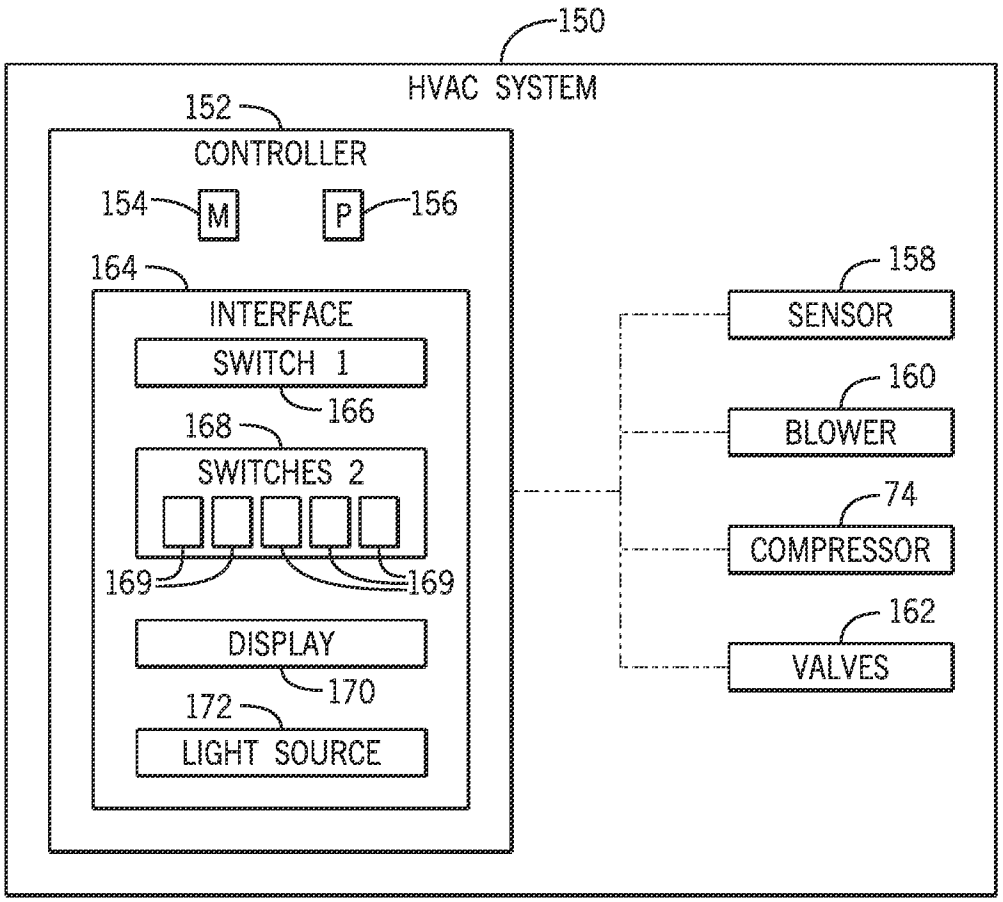
FIG. 5 is a schematic diagram of an embodiment of an HVAC system having electrical switches and a controller configured to enable operation of the HVAC system in a calibration mode, in accordance with an aspect of the present disclosure.

With this in mind, FIG. 5 is a schematic diagram of an embodiment of an HVAC system 150 configured to operate to condition an air flow and/or a space, such as for cooling, heating, and/or dehumidification purposes. For example, the HVAC system 150 may include a controller or control system 152 (e.g., an automation controller), which may include a memory 154 and/or processing circuitry 156. The memory 154 may include a non-transitory, computer-readable medium that may include volatile memory, such as random-access memory (RAM), and/or non-volatile memory, such as read-only memory (ROM), flash memory, optical drives, hard disc drives, solid-state drives, or any other non-transitory computer-readable medium storing instructions that, when executed by the processing circuitry 156, may control operation of the HVAC system 150. To this end, the processing circuitry 156 may include one or more application specific integrated circuits (ASICs), one or more field programmable gate arrays (FPGAs), one or more programmable logic devices (PLD), one or more programmable logic arrays (PLA), one or more general purpose processors, or any combination thereof configured to execute such instructions. The controller 152 may operate various components of the HVAC system 150 to condition the air flow and/or the space.

In some embodiments, the HVAC system 150 may include a sensor 158 configured to monitor an operating parameter of the HVAC system 150 and transmit sensor data to the controller 152 to indicate a value of the operating parameter. The controller 152 may be configured to operate the HVAC system 150 based on the sensor data. For example, the operating parameter may include or indicate an air flow rate (e.g., of a supply air flow, of an intake air flow), a humidity (e.g., of the air flow, of the space), a temperature (e.g., of the air flow, of the space, of a refrigerant), a particle level (e.g., of carbon dioxide), a refrigerant flow rate, a refrigerant pressure, another suitable operating parameter, or any combination thereof. For instance, the sensor 158 may be positioned at any suitable location, such as within ductwork, within a conduit, in the space, within a housing of the HVAC system 150, and the like, to monitor the operating parameter. The controller 152 may operate a component of the HVAC system 150 based on the value of the operating parameter indicated by the sensor data. For example, the controller 152 may operate a blower 160 to direct (e.g., draw, force) the air flow at a target flow rate based on the sensor data. Additionally or alternatively, the controller 152 may adjust operation of the compressor 74, such as a speed or stage of the compressor 74, and/or valves 162 (e.g., the expansion device 78), such as an opening of the valves 162, based on the sensor data.

The controller 152 may also operate the HVAC system 150 in a calibration mode and in a normal mode. In some embodiments, the controller 152 may operate the HVAC system 150 in a particular mode based on a user input. For example, the HVAC system 150 may include an interface 164, which may be a part of the controller 152 or may be a separate component that is communicatively coupled to the controller 152. The interface 164 may include a first electrical switch 166 (e.g., a manual on/off electrical switch, a biased electrical switch, a binary electrical switch) and a set of second electrical switches 168 (e.g., that includes multiple second electrical switches or contacts 169). The first electrical switch 166 and the set of second electrical switches 168 may be manually actuatable, adjustable, or configurable (e.g., to different configurations, to different positions, to different settings) switches or any other suitable electronic component that may enable the controller 152 to determine the adjustment of the electrical switches 166, 168 as user inputs. In some embodiments, the set of second electrical switches 168 may be packaged together as a DIP switch or a jumper block. By way of example, the first electrical switch 166 and/or the set of second electrical switches 168 may be disposed on a printed circuit board (PCB) of or associated with the controller 152. The interface 164 may be accessible to a user. For instance, the interface 164 may be exposed to enable user access to the interface 164. As such, the user may be able to access the first electrical switch 166 and/or the set of second electrical switches 168 to adjust operation of the HVAC system 150 (e.g., initiate operation of the HVAC system 150 in the calibration mode).

Actuation of the first electrical switch 166, such as to a first position, may enable the controller 152 to initiate the calibration mode of the HVAC system 150. In the calibration mode, the controller 152 may compare measured values (e.g., purported values) of an operating parameter determined by the sensor 158 with calibration values of the operating parameter that may be input via adjustment of the set of second electrical switches 168. For example, during the calibration mode, the controller 152 may operate the HVAC system 150 to achieve an actual value of the operating parameter. For instance, a user, such as a technician, an operator, a customer (e.g., a resident), or other user, may utilize an additional sensor (e.g., a calibration sensor) to monitor the operating parameter and detect the actual value during the calibration mode. While the sensor 158 may be installed as a resident component of the HVAC system 150 (e.g., to enable operation of the HVAC system 150 in the normal mode), the additional sensor, such as a testing, adjusting, and/or balancing (TAB) sensor, may be separate from the sensor 158 and may be temporarily positioned and utilized during the calibration mode. The additional sensor may be configured to accurately and/or precisely determine the actual value of the operating parameter (e.g., with greater accuracy, precision, and/or certainty than the sensor 158). However, in some embodiments, the additional sensor may not be communicatively coupled to the controller 152 or otherwise incorporated in the HVAC system 150 to operate the HVAC system 150 (e.g., in the normal mode). Thus, the controller 152 may not directly receive the actual value of the operating parameter output by the additional sensor. Instead, the set of second electrical switches 168 may be adjusted by the user to indicate a calibration value representing the actual value of the operating parameter determined by the additional sensor during the calibration mode. The actual value determined by the additional sensor, and therefore the calibration value indicated by the set of second electrical switches 168, may indicate a target or anticipated value expected to be determined by the sensor 158.

As mentioned above, during operation of the HVAC system 150 in the calibration mode, the controller 152 may receive the measured value of the operating parameter determined by the sensor 158. The controller 152 may compare the measured value determined by the sensor 158 with the calibration value indicated by the set of second electrical switches 168. As an example, the controller 152 may determine a difference or offset between the measured value and the calibration value. In some embodiments, the controller 152 may create a calibration profile based on the comparison between the measured value and the calibration value. Thereafter, the controller 152 may utilize (e.g., reference) the calibration profile and feedback from the sensor 158 during operation of the HVAC system 150 in the normal mode to condition the air flow and/or the space. For example, the calibration profile may include a modification, such as an offset value, a gain a multiplier, an equation, or other parameter value adjustment, to the measured values determined by the sensor 158 during the normal mode to adjust the measured values toward actual values of the operating parameter. That is, the adjusted measured values of the operating parameter may more accurately or precisely represent corresponding actual values of the operating parameter. By way of example, the operating parameter may be an air flow rate, the calibration value indicated by the set of second electrical switches 168 may be 3000 feet per minute (FPM), and the measured value determined by the sensor 158 may be 2500 FPM. Thus, the calibration profile may include a modification to the measured values such that 2500 FPM received by the sensor 158 is adjusted to 3000 FPM, and the controller 152 may operate the HVAC system 150 based on the 3000 FPM value of the operating parameter. In this manner, the calibration profile may enable operation of the HVAC system 150 based on more accurate values of the operating parameter, thereby improving overall operation of the HVAC system 150.

In some embodiments, the controller 152 may receive multiple calibration values and corresponding measured values to create the calibration profile. That is, the controller 152 may compare the multiple respective calibration values and measured values with one another in order to determine a relationship between the calibration values and the measured values. Based on the determined relationship, the controller 152 may generate a modification that may be applied to subsequent measured values (e.g., detected during normal mode operation) in order to provide more accurate values of the operating parameter that may be utilized during normal operation of the HVAC system 150. For instance, the controller 152 may compare two calibration values and corresponding measured values with one another, three or more calibration values and corresponding measured values with one another, or any suitable number of calibration values and corresponding measured values. The controller 152 may statistically analyze the relationship between the calibration values and the measured values to determine the modification to be made to the measured values and subsequent measured values, such as by using graphical techniques (e.g., linear regression).

In certain embodiments, the first electrical switch 166 and/or the set of second electrical switches 168 may be manually actuated to initiate operation of the HVAC system 150 in the calibration mode. For instance, the first electrical switch 166 may include a push button (e.g., a biased switch), a test pin, and/or a lever (e.g., a toggle switch). The set of second electrical switches 168, in some embodiments, may include a component that is already incorporated in certain existing configurations of the HVAC system 150. For example, the set of second electrical switches 168 may be a DIP switch configured to enable control of operational logic of the controller 152 (e.g., a baud rate for communicating data) during operation of the HVAC system 150 in the normal mode. Accordingly, the techniques described herein may be implemented without incorporation of certain additional components, such as an additional or dedicated controller (e.g., an additional or dedicated PCB), an additional graphical user interface, wiring, and so forth, and costs and/or a complexity associated with enabling operation of the HVAC system 150 in the calibration mode may be reduced. In such embodiments, the set of second electrical switches 168 may be maintained at a particular or expected position during operation of the HVAC system 150 in the normal mode to enable desirable operation of the HVAC system 150 in the normal mode. However, the configuration of the set of second electrical switches 168 may be adjusted to initiate the calibration mode and to enable input of calibration values during operation of the HVAC system 150 in the calibration mode.

As an example, the set of second electrical switches 168 may include a dual in-line package (DIP) switch. The DIP switch may include multiple electrical switches or contacts (e.g., the second electrical switches 169), each of which is adjustable between respective positions (e.g., first or second positions, open or closed positions, on or off positions). Different permutations of the respective positions of the second electrical switches 169 may indicate corresponding numerical values. For example, all of the second electrical switches 169 being in respective first positions may indicate a first numerical value (e.g., "0"), a one particular second electrical switch 169 being in a first position and remaining second electrical switches 169 being in respective second positions may indicate a second numerical value (e.g., "1"), two particular second electrical switches 169 being in respective first positions and remaining second electrical switches 169 being in respective second positions may indicate a third numerical value (e.g., "3"), and so forth. Actuation of the first electrical switch 166 during the calibration mode may indicate input of a numerical value based on the configuration of the set of second electrical switches 168. In other words, the controller 152 may determine and record a numerical value based on a configuration of the set of second electrical switches 168 in response to actuation of the first electrical switch 166 in the calibration mode.

In some embodiments, cooperative usage of the first electrical switch 166 and the set of second electrical switches 168 may enable input of the calibration value on a digit by digit basis. For instance, in order to input a calibration value of 3000 FPM, the configuration of the set of second electrical switches 168 may be adjusted to first indicate the numerical value "3" in the thousands decimal place value, and the first electrical switch 166 may be actuated (e.g., via pressing of a push button) to cause the controller 152 to record the indicated numerical value as the thousands decimal place value. The configuration of the set of second electrical switches 168 may then be adjusted to indicate the numerical value "0" in the hundreds decimal place value, and the first electrical switch 166 may be actuated to cause the controller 152 to record the indicated numerical value as the hundreds decimal place value. Similar operation of the first electrical switch 166 and the set of second electrical switches 168 may be repeated for the tens decimal place value and the ones decimal place value. Separate from receipt of the calibration value, the controller 152 may receive the corresponding measured value from the sensor 158. The controller 152 may compare the measured value received from the sensor 158 with the calibration value input via the set of second electrical switches 168. The techniques described herein may also be repeated to input other calibration values for comparing multiple calibration values and corresponding measured values with one another.

In additional or alternative embodiments, the set of second electrical switches 168 may include a different component, such as a jumper, a test pin header, another suitable component, or any combination thereof, that may be manually adjusted between different configurations to enable input of different calibration values. In further embodiments, the calibration value may be input remotely. For example, the controller 152 (e.g., the PCB on which the first electrical switch 166 and/or the set of second electrical switches 168 is disposed) may have a building automation and control (BAC) network (BACnet) connection and/or MODBUS network connection to enable communicative coupling with a device, such as a building automation system computer, configured to communicate with the controller 152. The user may therefore use the device to control operation of the HVAC system 150 remotely, such as to initiate operation of the HVAC system 150 in the calibration mode and/or the normal mode and/or to input calibration values during the operation of the HVAC system 150 in the calibration mode.

The interface 164 may also include other components to facilitate usage of the first electrical switch 166 and/or the set of second electrical switches 168 during operation of the HVAC system 150 (e.g., in the calibration mode). As an example, the interface 164 may include a display 170, which may include a light emitting diode (LED) display, a liquid crystal display (LCD), an electronic paper display, or other display or feedback device. The controller 152 may be communicatively coupled to the display 170 and may cause the display 170 to present a visual indication of information associated with operation of the HVAC system 150. For instance, the controller 152 may cause the display 170 to present a visual indication of the numerical value indicated by the configuration of the set of second electrical switches 168, a current operating mode (e.g., the calibration mode, the normal mode) of the HVAC system 150, a fault associated with operation of the HVAC system 150, other suitable information, or any combination thereof. In some embodiments, the controller 152 may operate the display 170 to flash the numerical value at a predetermined frequency (e.g., ⅓ seconds on, ⅓ seconds off) while the numerical value has not yet been set or recorded by the controller 152 and to maintain display of the numerical value after the numerical value has been set or recorded by the controller 152 (e.g., via actuation of the first electrical switch 166).

The interface 164 may additionally or alternatively include a light source 172 (e.g., a light output), such as an LED. The controller 152 may operate the light source 172 to emit a light based on operation of the HVAC system 150 (e.g., in the calibration mode). By way of example, the controller 152 may cause the light source 172 to flash a light at a first frequency (e.g., 0.1 seconds on, 0.1 seconds off) to indicate initiation of the calibration mode, at a second frequency (e.g., 0.1 seconds on, 0.1 seconds off) to indicate a numerical value of a decimal place of a calibration value has been entered and recorded, at a third frequency (e.g., 0.1 seconds on, 0.1 seconds off) to indicate an entire calibration value has been entered and recorded, at a fourth frequency (e.g., 0.5 seconds on, 0.5 seconds off) to indicate operation of the HVAC system 150 in the calibration mode has been completed (e.g., that a calibration profile has been created, that the HVAC system 150 is transitioning from operation in the calibration mode to operation in the normal mode), and so forth. In this manner, the user may utilize the display 170 and/or the light source 172 to adjust and input the calibration value and/or verify input of the calibration input, for example.

Each of FIGS. 6 and 7 described below illustrates a method or process associated with operation of the HVAC system 150. In some embodiments, each of the methods and/or one or more of the steps thereof may be performed by a single respective component or system, such as by the controller 152 (e.g., the processing circuitry 156). In additional or alternative embodiments, multiple components or systems may perform the steps for one or both of the methods. It should also be noted that additional steps may be performed with respect to the described methods. Moreover, certain steps of the depicted methods may be removed, modified, and/or performed in a different order. Further still, the steps of any of the respective methods may be performed in any suitable relationship relative to one another, such as in parallel with, in response to, and/or sequentially relative to one another.

Figure 6:
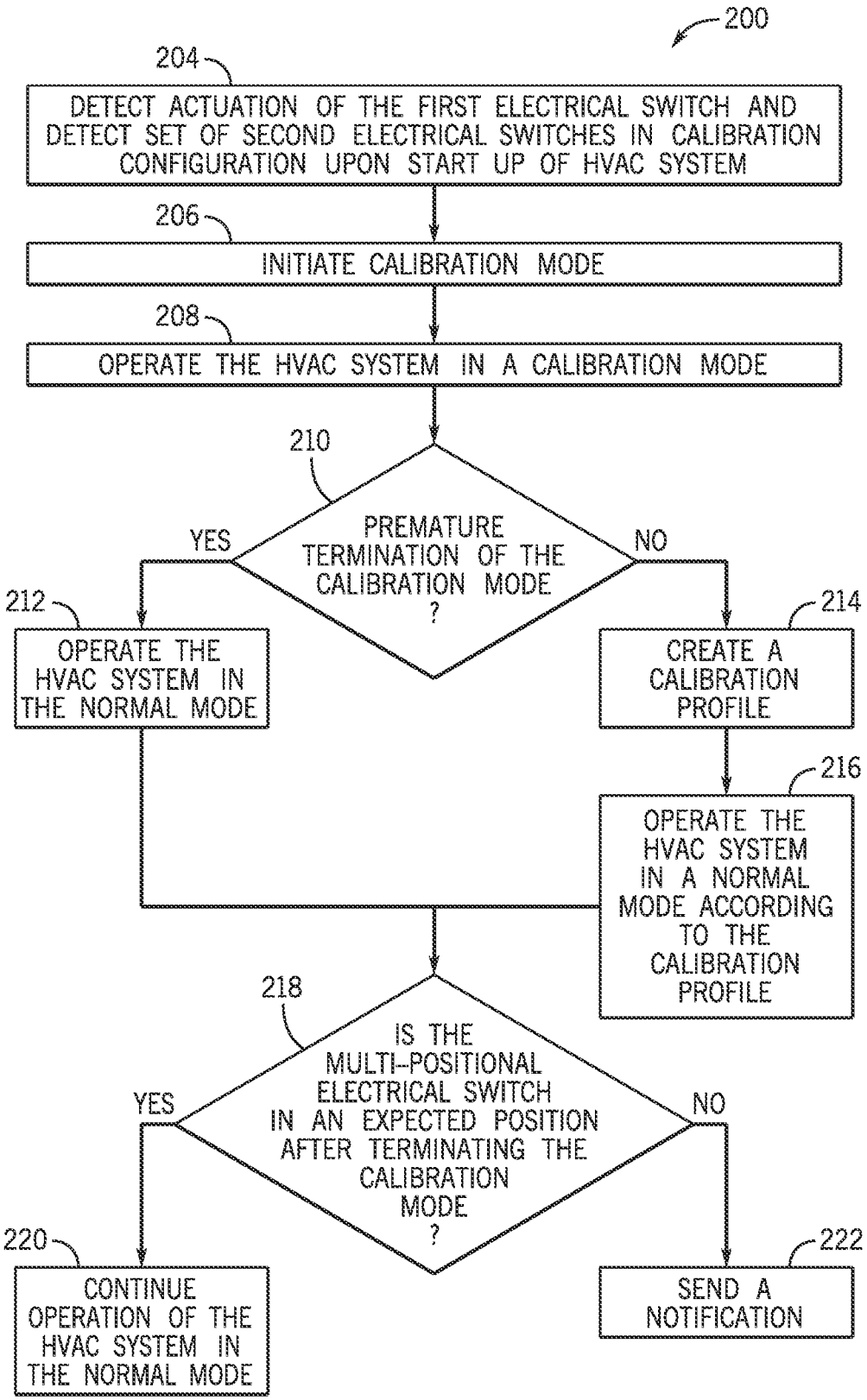
FIG. 6 is a flowchart of an embodiment of a method or process for operating an HVAC system based on positions of electrical switches.

FIG. 6 is a flowchart of an embodiment of a method or process 200 for operating the HVAC system 150 based on the input received via the first electrical switch 166 and the set of second electrical switches 168. Prior to performance of the method 200, the HVAC system 150 may initially be operated in a normal mode to condition an air flow and/or a space (e.g., without comparing a measured value of an operating parameter determined by the sensor 158 to a calibration value of the operating parameter indicated by the set of second electrical switches 168. In some embodiments, such operation in the normal mode may be based on a previously created calibration profile (e.g., based on operation in a previous calibration mode). The previously created calibration profile may include a modification or adjustment to the measured values (e.g., toward actual or expected values of the operating parameter) determined by the sensor 158 during operation of the HVAC system 150 in the normal mode. That is, the HVAC system 150 may operate based on the adjusted measured values. In additional or alternative embodiments, the HVAC system 150 may not operate based on a previously created calibration profile. For example, the HVAC system 150 may not have been operated in a previous calibration mode. As such, the HVAC system 150 may operate based on the unadjusted measured values determined by the sensor 158.

At block 204, a determination is made that the first electrical switch 166 is actuated (e.g., initially actuated) and that the set of second electrical switches 168 is in a calibration configuration (e.g., an initial configuration). For example, a determination may be made that the first electrical switch 166 is actuated and that the set of second electrical switches 168 is in the calibration configuration upon startup of the HVAC system 150 (e.g., a transition from a non-powered up state to a powered up state). Thus, in some embodiments, an ongoing operation of the HVAC system 150, such as in the normal mode, may initially be suspended (e.g., the HVAC system 150 is shut down) before the step of block 204 is completed. In an embodiment in which the set of second electrical switches 168 includes a DIP switch, the calibration configuration may include all second electrical switches 169 of the DIP switch being in respective first positions. In such embodiments, the second electrical switches 169 may be positioned in another configuration during operation of the HVAC system 150 in the normal mode to enable other functionality of the HVAC system 150. Thus, in accordance with present techniques, the HVAC system 150 may be shut down, and the set of second electrical switches 168 may be adjusted to the calibration configuration. With the set of second electrical switches 168 in the calibration configuration, the first electrical switch 166 (e.g., a push button) may be actuated, and the HVAC system 150 may be powered up.

Based on the detection of block 204, the HVAC system 150 may initiate or enter the calibration mode to determine a parameter value adjustment, as indicated at block 206. Initiation of the calibration mode based on the detection of block 204 may enable verification that entering the calibration mode is desired and/or may block inadvertent initiation of the calibration mode, such as during operation of the HVAC system 150 in the normal mode. The display 170 and/or the light source 172 may also be operated to indicate initiation of the calibration mode (e.g., instead of in the normal mode) upon startup of the HVAC system 150. Alternatively, in response to a determination that the set of second electrical switches 168 is not in the calibration position during the actuation of the first electrical switch 166 (e.g., upon startup of the HVAC system 150), initialization of the calibration mode may be blocked, and the HVAC system 150 may instead be operated in the normal mode. Further still, in certain embodiments, operation of the HVAC system 150 in the calibration mode may be blocked based on a determination that there is a fault or other event (e.g., a scheduled maintenance) associated with the HVAC system 150. Upon initialization of the calibration mode, the HVAC system 150 may then be operated in the calibration mode, as indicated by block 208.

At block 210, a determination may be made (e.g., by the controller 152) regarding whether an indication of a premature termination of the operation of the HVAC system 150 in the calibration mode, such as prior to determination of the parameter value adjustment, has been identified. That is, a determination may be made regarding whether an indication to terminate operation in the calibration mode prior to completion of the calibration mode has been identified. As an example, the premature termination of the operation in the calibration mode may be identified based on a particular actuation of the first electrical switch 166, such as actuation of the first electrical switch 166 exceeding a threshold termination period of time (e.g., a first threshold period of time, holding a push button for greater than 5 seconds) and/or a particular configuration of the set of second electrical switches 168 (e.g., during actuation of the first electrical switch 204). As another example, the premature termination of the operation in the calibration mode may be identified based on operation of the HVAC system 150 in the calibration mode for greater than a threshold operation period of time (e.g., a second threshold period of time, 15 minutes, 30 minutes, 45 minutes, 1 hour). As a further example, the premature termination of the operation in the calibration mode may be identified based on a determination that the first electrical switch 166 has not been actuated and/or that the set of second electrical switches 168 has not been adjusted for a threshold actuation period of time (e.g., a third threshold period of time). Indeed, the premature termination of the operation in the calibration mode may be manually indicated by a user and/or automatically determined (e.g., by the controller 152).

At block 212, in response to a determination that an indication of a premature termination of the operation in the calibration mode has been identified, the HVAC system 150 may transition from operation in the calibration mode to operation in the normal mode. In some embodiments, the HVAC system 150 may operate in a previous normal mode. That is, in embodiments in which the HVAC system 150 was operating in the normal mode based on a previously created calibration profile prior to initiating operation in the calibration mode, the HVAC system 150 may be operated in the normal mode based on the same previously created profile upon terminating operation in the calibration mode. In embodiments in which the HVAC system 150 was operating in the normal mode based on unadjusted measured values from the sensor 158 prior to initiating operation in the calibration mode (e.g., the HVAC system 150 was not operating based on a previously created calibration profile), the HVAC system 150 may be operated in the normal mode based on the unadjusted measured values from the sensor 158 upon prematurely terminating operation in the calibration mode.

At block 214, in response to a determination that an indication of a premature termination of the operation in the calibration mode has not been identified, operation of the HVAC system 150 in the calibration mode may be completed to create a calibration profile that may include the parameter value adjustment, in accordance with the techniques described above. The operation of the HVAC system 150 in the calibration mode may then be terminated after creation of the calibration profile. The calibration profile may include an updated adjustment or modification to be made to measured values determined by the sensor 158 during the normal mode in order to adjust the measured values toward actual values. At block 216, the HVAC system 150 may be operated based on the calibration profile in the normal mode, such as by applying the parameter value adjustment of the calibration profile to measured values determined by the sensor 158. In this manner, the HVAC system 150 may be operated based on updated, adjusted measured values determined by the sensor 158, and the updated, adjusted measured values may more accurately reflect the actual values of the operating parameter used to operate the HVAC system 150. As such, the HVAC system 150 may be operated more accurately or desirably in the normal mode based on the operating parameter.

At block 218, after termination of the calibration mode (e.g., whether premature or after completion of the calibration mode), a determination may be made regarding whether the set of second electrical switches 168 has been adjusted to an expected configuration associated with the operation of the HVAC system 150 in the normal mode, such as within a threshold adjustment period of time (e.g., a fourth threshold period of time, 1 minute, 3 minutes, 5 minutes, 10 minutes) after operation of the HVAC system 150 in the calibration mode has terminated. Indeed, the set of second electrical switches 168 may be adjusted from the expected configuration to cause the HVAC system 150 to initiate operation in the calibration mode, and/or the set of second electrical switches 168 may be adjusted from the expected configuration during operation of the HVAC system 150 in the calibration mode (e.g., to input calibration values used for creating the calibration profile). The set of second electrical switches 168 may be returned to the expected configuration (e.g., from the calibration position and after termination of the calibration mode operation) to enable operation of the HVAC system 150 in the normal mode (e.g., to enable the controller 152 to communicate at a target rate) as desired.

At block 220, in response to a determination that the set of second electrical switches 168 is in the expected configuration upon termination of the operation of the HVAC system 150 in the calibration mode (e.g., within the threshold adjustment period of time after termination of the operation in the calibration mode), the HVAC system 150 may be operated in the normal mode based on the expected configuration of the set of second electrical switches 168. At block 222, in response to a determination that the set of second electrical switches 168 is not in the expected configuration upon termination of the operation in the calibration mode (e.g., within the threshold adjustment period of time after termination of the operation in the calibration mode), a notification may be transmitted. For example, the configuration (e.g., the calibration configuration) of the set of second electrical switches 168 may not cause the HVAC system 150 to operate in the normal mode as desired (e.g., the configuration of the set of second electrical switches 168 may cause the controller 152 to communicate data at an undesirable rate). Thus, the notification may be transmitted to prompt a user to adjust the configuration of the set of second electrical switches 168 toward the expected configuration. As an example, the notification may be transmitted (e.g., by the controller 152) to a device (e.g., a mobile device) associated with the user. As another example, the display 170 and/or the light source 172 may be operated to output the notification. In certain embodiments, operation of the HVAC system 150 may be suspended and/or limited in response to a determination that the set of second electrical switches 168 is not in the expected configuration after termination of the operation in the calibration mode.

Figure 7:
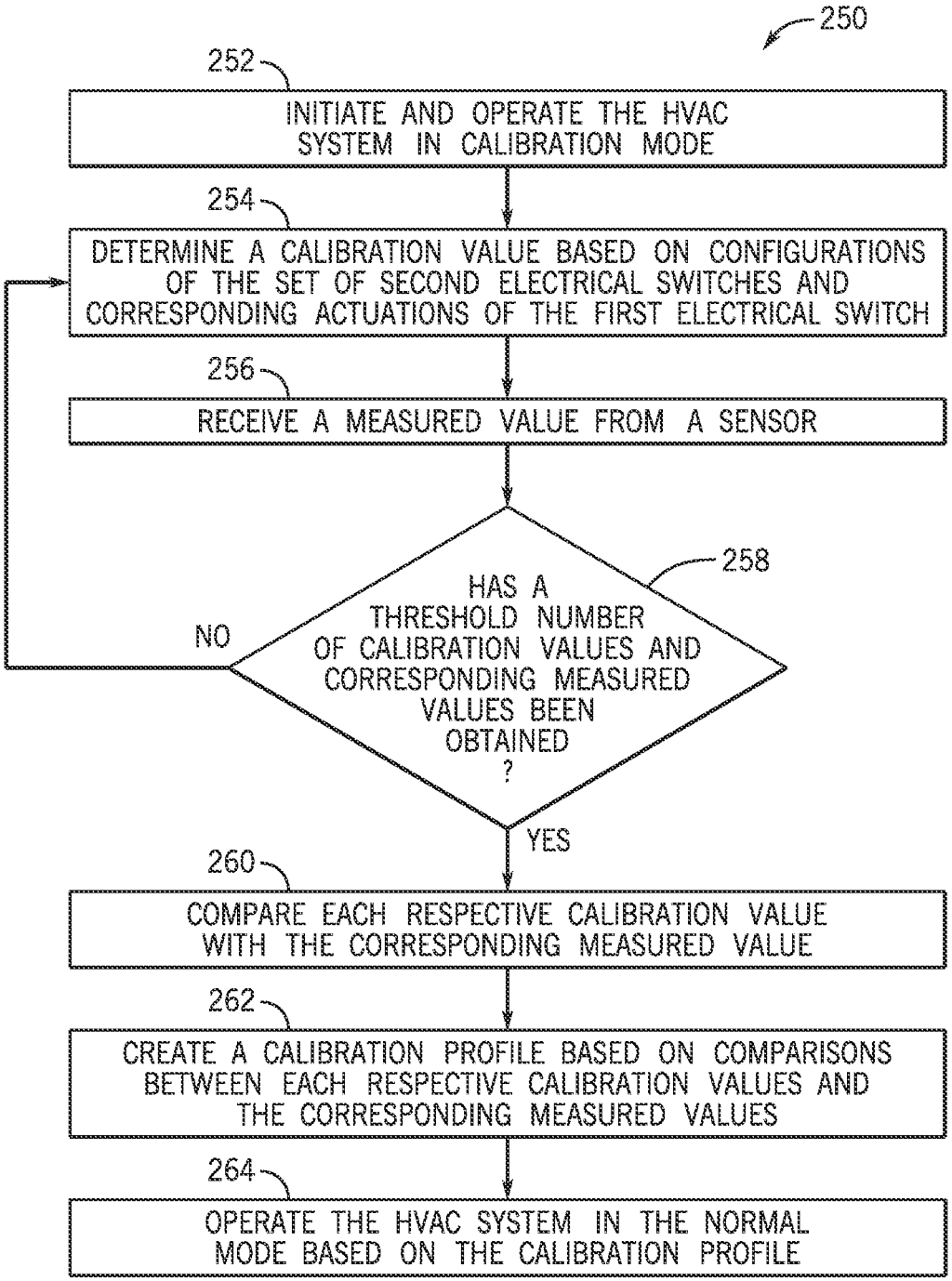
FIG. 7 is a flowchart of an embodiment of a method or process for operating an HVAC system in a calibration mode, in accordance with an aspect of the present disclosure.

FIG. 7 is a flowchart of an embodiment of a method or process 250 for operating the HVAC system 150 in the calibration mode. At block 252, operation of the HVAC system 150 is initiated in the calibration mode, such as based on a determined actuation of the first electrical switch 166 while the set of second electrical switches 168 is in the calibration configuration upon startup of the HVAC system 150. During operation of the HVAC system 150 in the calibration mode, the HVAC system 150 may be operated to achieve a particular value of an operating parameter. The particular value may include a value of the operating parameter that is desired to be achieved during operation in the normal mode. In some embodiments, a user may monitor an actual value of the operating parameter with a separate sensor (e.g., a sensor that is not used to operate the HVAC system 150 in the normal mode, a calibration sensor) and may adjust operation of the HVAC system 150 until the separate sensor indicates that the particular value has been achieved in the calibration mode.

During operation of the HVAC system 150 to achieve the particular value, the configuration of the set of second electrical switches 168 may be adjusted to input the particular value as a calibration value, such as to indicate each digit of a particular calibration value. Thus, at block 254, the calibration value may be determined and recorded based on one or more configurations of the set of second electrical switches 168 and corresponding actuations of the first electrical switch 166. That is, the first electrical switch 166 and the set of second electrical switches 168 may be operated in conjunction with one another to input and record the calibration value. For example, the set of second electrical switches 168 may be adjusted to indicate the respective numerical value associated with each decimal place value of the calibration value, and the first electrical switch 166 may be actuated (e.g., for a time frame below the threshold termination period of time) to input and record each individual numerical value. The first electrical switch 166 may additionally or alternatively be actuated to confirm the overall calibration value (e.g., to indicate that all numerical values associated with the calibration value have been input and recorded). In some embodiments, the display 170 and/or the light source 172 may be operated to indicate input and recordation of the numerical values and/or of the calibration value. At block 256, a measured value determined by the sensor 158 may be received during operation of the HVAC system 150 to achieve the particular value input as the calibration value.

At block 258, a determination is made regarding whether a threshold number of calibration values and corresponding measured values been obtained (e.g., input and/or recorded). In some embodiments, such as for a component having an on/off operation (e.g., a single speed fan, a single speed compressor), a single calibration value and corresponding measured value may be obtained. In additional or alternative embodiments, multiple calibration values and corresponding measured values may be obtained. In such embodiments, the steps described with respect to blocks 254-258 may be repeated until the threshold number of calibration values and corresponding measured values have been obtained. As an example, for a component (e.g., a fan) configured to operate in two modes (e.g., a high air flow rate mode, a low air flow rate mode), two calibration values and corresponding measured values respectively associated with the modes may be obtained. As another example, for a component configured to operate in more than two modes (e.g., a variable speed fan), three or more calibration values and corresponding measured values may be obtained. Indeed, obtaining a higher quantity of calibration values and corresponding measured values may more accurately establish the relationship between the measured values and the actual values to create the calibration profile. In certain embodiments, blocks 254-258 may be performed to obtain the calibration values and corresponding measured values in ascending order. That is, for example, a low calibration value and corresponding measured value may be obtained, a middle calibration value and corresponding measured value may be obtained, and a high calibration value and corresponding measured value may be obtained. In additional or alternative embodiments, blocks 254-258 may be performed to obtain calibration values and corresponding measured values in descending order or in any suitable order.

At block 260, each respective calibration value may be compared with the corresponding measured value. By way of example, a respective difference between each calibration value and corresponding measured value may be determined. At block 262, a calibration profile may be created based on the comparisons between each respective calibration value and the corresponding measured value. The calibration profile may indicate a modification to the measured values that adjusts the measured values toward the corresponding calibration values. In an example, the calibration profile may include an offset or gain to be applied to the measured values. In another example, the calibration profile may include an equation to be applied to the measured values.

At block 264, after creation of the calibration profile, the HVAC system 150 may transition from operating in the calibration mode to operating in the normal mode based on the calibration profile. In some embodiments, the operation of the HVAC system 150 may automatically transition from the calibration mode to the normal mode upon creation of the calibration profile. In additional or alternative embodiments, the operation of the HVAC system 150 may transition from the calibration mode to the normal mode in response to a user input received after creation of the calibration profile, such as an actuation of the first electrical switch 166. During operation of the HVAC system 150 in the normal mode based on the calibration profile, subsequent measured values may be received from the sensor 158, and the subsequent measured values detected by the sensor 158 may be adjusted based on the modification indicated by the calibration profile. In this manner, the HVAC system 150 may operate based on adjusted measured values that better reflect actual values of an operating parameter.

It should be noted that the method 250 may be performed to create a calibration profile that applies adjustments to each different sensor incorporated in the HVAC system 150. For example, during operation of the method 250, the calibration value associated with multiple sensors may be determined (e.g., based on input received via the set of second electrical switches 168), and respective measured values from each of the sensors may be received. The calibration profile created via operation of the HVAC system 150 in the calibration mode may indicate a respective adjustment to the measured values determined by each of the sensors. In this manner, operation of the HVAC system 150 in a single calibration mode may create a calibration profile configured to adjust measured values determined by multiple sensors, such as sensors configured to monitor operating parameters at different locations of the HVAC system 150 (e.g., sensors configured to monitor air flow at different locations in ductwork and/or the an air handling unit of the HVAC system 150). Additionally, it should be noted that the method 250 may be performed at any suitable time, such as during installation of the HVAC system 150 or after installation of the HVAC system 150 (e.g., at a predetermined frequency, at predetermined time stamps, after a predetermined number of run cycles).

The present disclosure may provide one or more technical effects useful in the operation of an HVAC system. For example, the HVAC system may include a first electrical switch and a set of second electrical switches. The HVAC system may also include a controller configured to operate the HVAC system. During operation in a normal mode, the controller may operate the HVAC system to condition a supply air flow and/or a space based on measured values of an operating parameter determined by a sensor of the HVAC system. The controller may also communicate data based on the configuration of the set of second electrical switches during operation in the normal mode. The controller may also operate the HVAC system in a calibration mode in response to detecting actuation of the first electrical switch and a particular configuration of the set of second electrical switches (e.g., upon startup of the HVAC system). During the calibration mode, the controller may determine a calibration value based on the configuration of the set of second electrical switches, and the calibration value may represent an actual, expected, or target value of the operating parameter being monitored by the sensor. The controller may also receive a corresponding measured value from the sensor during operation of the HVAC system in the calibration mode. Based on a comparison between the calibration value and the measured value, the controller may create a calibration profile that includes an adjustment of the corresponding measured value toward the calibration value. The controller may operate the HVAC system in the normal mode based on the calibration profile by applying the adjustment of measured values received from the sensor during the normal mode. In this way, the HVAC system may be operated more desirably to condition an air flow and/or a space during the normal mode. The technical effects and technical problems in the specification are examples and are not limiting. It should be noted that the embodiments described in the specification may have other technical effects and can solve other technical problems.

While only certain features and embodiments of the disclosure have been illustrated and described, many modifications and changes may occur to those skilled in the art, such as variations in sizes, dimensions, structures, shapes and proportions of the various elements, values of parameters, including temperatures and pressures, mounting arrangements, use of materials, colors, orientations, and so forth without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the exemplary embodiments, all features of an actual implementation may not have been described, such as those unrelated to the presently contemplated best mode of carrying out the disclosure, or those unrelated to enabling the claimed disclosure. It should be noted that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A heating, ventilation, and/or air conditioning (HVAC) system, comprising:

a set of electrical switches;

an additional electrical switch; and a controller configured to:

operate the HVAC system in a calibration mode;

determine a calibration value of an operating parameter of the HVAC system based on a plurality of configurations of the set of electrical switches during operation of the HVAC system in the calibration mode;

determine the calibration value of the operating parameter based on a plurality of actuations of the additional electrical switch respectively corresponding to the plurality of configurations of the set of electrical switches during the operation of the HVAC system in the calibration mode;

receive a measured value of the operating parameter from a sensor of the HVAC system during the operation of the HVAC system in the calibration mode;

determine a parameter value adjustment for the measured value based on a comparison of the measured value and the calibration value; and operate the HVAC system in the calibration mode in response to a detection of an initial configuration of the set of electrical switches and a detection of an initial actuation of the additional electrical switch.

2. The HVAC system of claim 1, wherein the additional electrical switch comprises a push button, a test pin, a biased switch, or a lever.

3. The HVAC system of claim 1, wherein the controller comprises a printed circuit board, and the set of electrical switches and the additional electrical switch are disposed on the printed circuit board.

4. The HVAC system of claim 1, comprising a display, wherein the controller is configured to operate the display to present a visual indication of the calibration value.

5. The HVAC system of claim 1, further comprising a light source, wherein the controller is configured to operate the light source to emit a light based on the operation of the HVAC system in the calibration mode.

6. The HVAC system of claim 1, wherein the controller is configured to operate the HVAC system in a normal mode based on the parameter value adjustment.

7. The HVAC system of claim 6, wherein the controller is configured to communicate data based on another configuration of the set of electrical switches during operation of the HVAC system in the normal mode.

8. The HVAC system of claim 1, comprising a dual in-line package (DIP) switch comprising the set of electrical switches or a jumper block comprising the set of electrical switches.

9. A non-transitory, computer-readable medium comprising instructions that, when executed by processing circuitry, are configured to cause the processing circuitry to:

operate a heating, ventilation, and/or air conditioning (HVAC) system in a calibration mode;

determine a calibration value of an operating parameter of the HVAC system based on a plurality of configurations of a set of electrical switches of the HVAC system during operation of the HVAC system in the calibration mode;

determine a parameter value adjustment for a measured value received via a sensor of the HVAC system based on a comparison of the measured value and the calibration value in the calibration mode;

communicate data based on an additional configuration of the set of electrical switches during operation of the HVAC system in a normal mode;

receive an indication to terminate the operation of the HVAC system in the calibration mode prior to determination of the parameter value adjustment; and transition operation of the HVAC system to the normal mode in response to receiving the indication to terminate the operation of the HVAC system in the calibration mode prior to determination of the parameter value adjustment.

10. The non-transitory, computer-readable medium of claim 9, wherein the instructions, when executed by the processing circuitry, are configured to cause the processing circuitry to initiate the calibration mode of the HVAC system in response to detecting an initial configuration of the set of electrical switches and detecting an actuation of an additional electrical switch of the HVAC system.

11. The non-transitory, computer-readable medium of claim 10, wherein the instructions, when executed by the processing circuitry, are configured to cause the processing circuitry to initiate the calibration mode in response to detecting the initial configuration of the set of electrical switches and detecting the actuation of the additional electrical switch during startup of the HVAC system.

12. The non-transitory, computer-readable medium of claim 9, wherein the instructions, when executed by the processing circuitry, are configured to cause the processing circuitry to:

receive an additional measured value from the sensor in the normal mode of the HVAC system; and adjust the additional measured value by the parameter value adjustment.

13. The non-transitory, computer-readable medium of claim 9, wherein the instructions, when executed by the processing circuitry, are configured to cause the processing circuitry to:

detect the additional configuration of the set of electrical switches upon termination of the calibration mode; and output a notification in response to determining that the additional configuration is not an expected configuration of the set of electrical switches.

14. The non-transitory, computer-readable medium of claim 9, wherein the instructions, when executed by the processing circuitry, are configured to cause the processing circuitry to:

determine an additional calibration value based on a plurality of other configurations of the set of electrical switches during the operation of the HVAC system in the calibration mode;

receive an additional measured value from the sensor; and determine the parameter value adjustment based on the comparison of the measured value and the calibration value and based on an additional comparison of the additional measured value and the additional calibration value.

15. A controller, comprising:

a set of electrical switches;

an additional electrical switch;

processing circuitry; and a memory comprising instructions that, when executed by the processing circuitry, are configured to cause the processing circuitry to:

initiate operation in a calibration mode in response to a detection of an initial configuration of the set of electrical switches and a detection of an initial actuation of the additional electrical switch;

determine a plurality of air flow rate calibration values based on a plurality of configurations of the set of electrical switches during the operation in the calibration mode;

receive a first plurality of measured air flow rate values from a sensor during the operation in the calibration mode, wherein each measured air flow rate value of the first plurality of measured air flow rate values corresponds to an air flow rate calibration value of the plurality of air flow rate calibration values;

determine an adjustment to a second plurality of measured air flow rate values received from the sensor during operation in a normal mode based on a comparison of the plurality of air flow rate calibration values and the first plurality of measured air flow rate values; and operate in the normal mode based on the adjustment to the second plurality of measured air flow rate values.

16. The controller of claim 15, wherein the instructions, when executed by the processing circuitry, are configured to cause the processing circuitry to transition the operation from the calibration mode to the normal mode after determining the adjustment to the second plurality of measured air flow rate values.

17. The controller of claim 15, wherein the instructions, when executed by the processing circuitry, are configured to cause the processing circuitry to determine each respective air flow rate calibration value of the plurality of air flow rate calibration values based on a subset of the plurality of configurations of the set of electrical switches, wherein each configuration of the subset of the plurality of configurations corresponds to a digit of the air flow rate calibration value.

* * * * *